United States Patent [19]

Koch

[11] 4,351,514

[45] Sep. 28, 1982

[54] APPARATUS FOR PURIFYING MOLTEN METAL

[76] Inventor: Fenton C. Koch, 12706 Rockhaven Rd., Chesterland, Ohio 44026

[21] Appl. No.: 169,998

[22] Filed: Jul. 18, 1980

[51] Int. Cl.[3] ..... C21C 7/072

[52] U.S. Cl. ..... 266/217; 266/235; 261/29; 261/DIG. 75; 417/66; 75/93 R

[58] Field of Search ..... 266/217, 233, 235; 75/68 R, 93 R, 93 E; 261/29, 93 R, DIG. 75; 417/66

[56] References Cited

U.S. PATENT DOCUMENTS

| | | | |
|---|---|---|---|
| 2,865,618 | 12/1958 | Abell | 261/93 |
| 2,948,524 | 8/1960 | Sweeney et al. | 415/214 X |
| 3,521,864 | 7/1970 | Welles | 261/DIG. 75 |
| 3,807,708 | 4/1970 | Jones | 261/DIG. 75 |
| 4,003,560 | 1/1977 | Carbonnel | 266/217 |
| 4,052,199 | 10/1977 | Mangalick | 75/68 R |

FOREIGN PATENT DOCUMENTS

| | | | |
|---|---|---|---|
| 53-46795 | 12/1978 | Japan | 261/DIG. 75 |

OTHER PUBLICATIONS

O'Rourke, C. E., *Gen. Eng. Handbook,* 2nd Ed., McGraw Hill Book Co.; N.Y., 1940; pp. 798–799.

*Primary Examiner*—G. O. Peters

*Attorney, Agent, or Firm*—Watts, Hoffmann, Fisher & Heinke Co.

[57] ABSTRACT

An improved molten metal pump and gas injection apparatus comprising a submersible pump housing 10 enclosing a rotatable impeller 30, an impeller drive 12 supported above the housing and an elongate drive shaft 16 operatively connected to the impeller. Rotation of the drive shaft effects fluid flow between a pump inlet 35 and a pump outlet 44 both being at least partially defined by the impeller housing. A gas injection conduit 54 extends downwardly from a drive motor support platform 20 and includes an output end 54*a* that terminates near the pump inlet and which is received by a gas inlet collar 58 that defines a venturi 60, coaxial with the axis of the pump inlet. A passage 62 formed in the collar communicates the end of the gas injection conduit with the throat of the venturi so that the gas is injected into the incoming molten metal in an area of low pressure, thereby reducing the gas pressure needed to effect injection.

5 Claims, 7 Drawing Figures

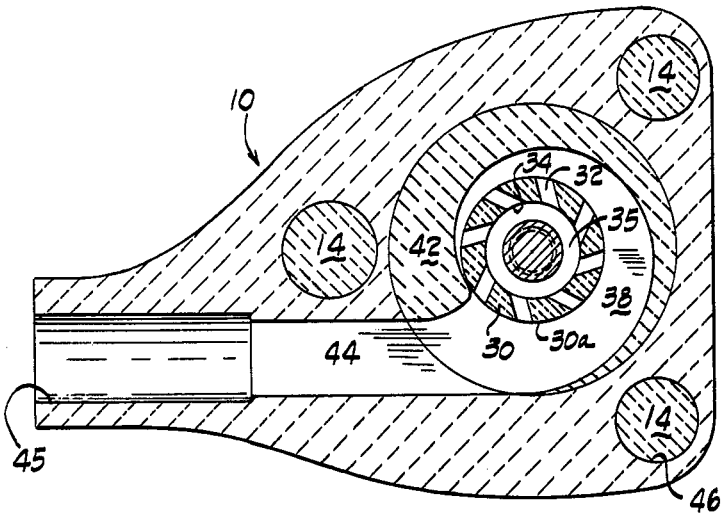
Fig. 3
Fig. 4
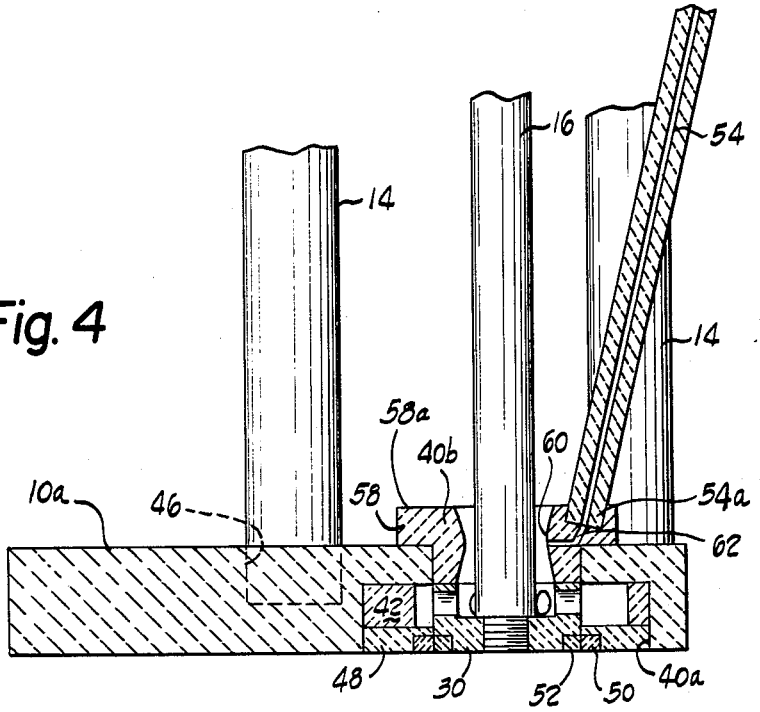

APPARATUS FOR PURIFYING MOLTEN METAL

TECHNICAL FIELD

The present invention relates generally to devices and methods for conveying and purifying molten metal, and in particular to an improved molten metal pump that includes a gas injection apparatus.

BACKGROUND ART

It is often desired to cleanse non-ferrous molten metal such as aluminum of impurities prior to a casting process. The impurities include dissolved gas such as hydrogen and/or dissolved metal such as magnesium. The processes of removing dissolved gasses and metals are more commonly referred to as "degassing" and "demagging", respectively.

Methods currently being used by industry for accomplishing demagging and degassing typically include a fluxing process in which a reactive gas, such as chlorine, is mixed with the molten metal. Theoretically, the chlorine gas being more reactive than the molten metal, preferentially combines with the impurities i.e., magnesium, to form light weight compounds that can be easily removed from the molten bath. One such process and apparatus for practicing the process is disclosed in U.S. Pat. No. 4,052,199 and U.S. Pat. No. 4,169,589 both issued to Mangalick and assigned to the Carborundum Company. The patents disclose an apparatus comprising two metallic bath chambers that communicate with each other through a submerged metal transfer conduit. A molten metal pump located in the first chamber pumps molten metal from the first chamber to the second chamber by way of the transfer conduit. A gas injection conduit communicates with the metal transfer conduit and is operative to inject chlorine gas into the molten metal discharged by the pump outlet.

A problem universal to fluxing processes is the potential for uncontrolled escape of chlorine gas or toxic reactants into the atmosphere or working environment. For this reason the rate of chlorine injection into the molten metal must be carefully controlled so that an amount in excess of that which can combine with the impurities is not injected. Apparatus and methods have been suggested which allegedly minimize the escape of raw chlorine gas.

Molten metal pumps are often used to circulate and/or transfer non-ferrous molten materials. One such pump is disclosed in U.S. Pat. No. 2,948,524 issued to Sweeney et. al. and assigned to The Carborundum Company, and apparently forms the pumping means for the gas injection apparatus disclosed in U.S. Pat. No. 4,169,584. The pump comprises a submerged impeller housing that rotatably supports an annular impeller having a plurality of radial ports that communicate a circumferential surface of the impeller with a central bore that defines an inlet to the pump. A platform supporting a driving mechanism is supported above the impeller housing by support posts and the driving mechanism drivingly engages the impeller through a drive shaft that extends from the platform and threadedly engages the impeller. In operation, rotation of the impeller draws molten metal into the inlet from where it travels through the radial bores into the impeller housing, finally being discharged into an outlet conduit.

In the gas injection apparatus disclosed in U.S. Pat. No. 4,169,584, the chlorine gas is injected at the outlet of a Sweeney type pump. This gas injection configuration presents at least two problems. First, the gas is being injected into a fluid under pressure and therefore the injection pressure must exceed the pressure of the fluid. More importantly, the amount of gas discharged will vary with changes in the outlet pressure of the pump. Secondly, in order to provide sufficient contact time with the molten metal, a submerged discharge configuration is required. It would appear that a discharge riser for conveying the molten metal upwardly out of the bath cannot be accommodated. The molten metal must be discharged below the surface of the second bath in order to minimize the potential for gas escape.

DISCLOSURE OF INVENTION

The present invention provides a new and improved molten metal pump that includes a gas injection apparatus which is not hindered by the disadvantages of the prior art. Specifically, the present invention can be embodied in either a submerged discharge pump or a transfer pump having a discharge riser.

In a preferred embodiment, the present invention comprises a submerged impeller housing rotatably supporting an impeller which when rotated conveys molten metal from an inlet to an outlet defined by the housing, and a gas injection arrangement for introducing a reactive gas such as chlorine near the inlet to the impeller housing. An impeller drive motor is supported above the impeller housing by support members and is connected to the impeller by a drive shaft.

In the preferred construction, the gas injection apparatus comprises a conduit having an output end disposed below the surface of the molten metal and positioned in proximity to the inlet to the impeller housing so that gas discharged by the conduit is drawn into the inlet and mixed with the incoming molten metal.

Unlike the prior art, the present invention is adaptable to either a submerged discharge pump or a transfer pump having a discharge riser. Mixing of the reactive gas with the molten metal and hence metal-to-gas contact is enhanced due to the turbulence normally present in the pump housing. Moreover, the flow rate of the reactive gas into the inlet is substantially unaffected by the discharge pressure at the outlet.

According to a feature of the invention, the gas injection apparatus further comprises a gas injection member, preferably annular shaped, mounted in the vicinity of the inlet, shaped to define a venturi passage coaxial with the inlet. A flow passage including a radial portion communicates the output end of the gas injection conduit with the throat of the venturi. By introducing the reactive gas at the throat of the venturi, relatively low pressures can be employed, reducing the likelihood of uncontrolled gas escape due to imcomplete mixing or combining with the molten metal.

According to another feature of the invention the gas injection conduit extends from the drive motor platform and is positioned between the drive shaft and the platform support members. With this configuration, virtually the entire extent of the gas conduit is protected for it does not extend beyond the perimeter of the pump. Consequently the size of the overall device is reduced and the chance of conduit breakage is minimized.

The gas injection apparatus disclosed provides yet another outstanding feature of the invention. In the preferred embodiment, the output end of the gas injection conduit is mounted in the annular gas injection member and positioned a radial distance from the axis of the pump inlet. With this configuration, the position of the conduit with respect to the overall pump can be easily modified to accommodate or obviate on-site clearance problems. Alternate positioning of the conduit is achieved by rotating the injection member and refastening the upper end of the conduit to the platform at a new location.

Additional features and a fuller understanding of the invention will be obtained in reading the following detailed description made in connection with the accompanying drawings.

BRIEF DESCRIPTION OF THE DRAWINGS

FIG. 3 is a sectional view of the pump shown in FIG. 1 as seen from the plane indicated by the line 3—3 in FIG. 1;

FIG. 4 is a fragmentary sectional view as seen along the line 4—4 in FIG. 2;

BEST MODE FOR CARRYING OUT THE INVENTION

Figure 1:
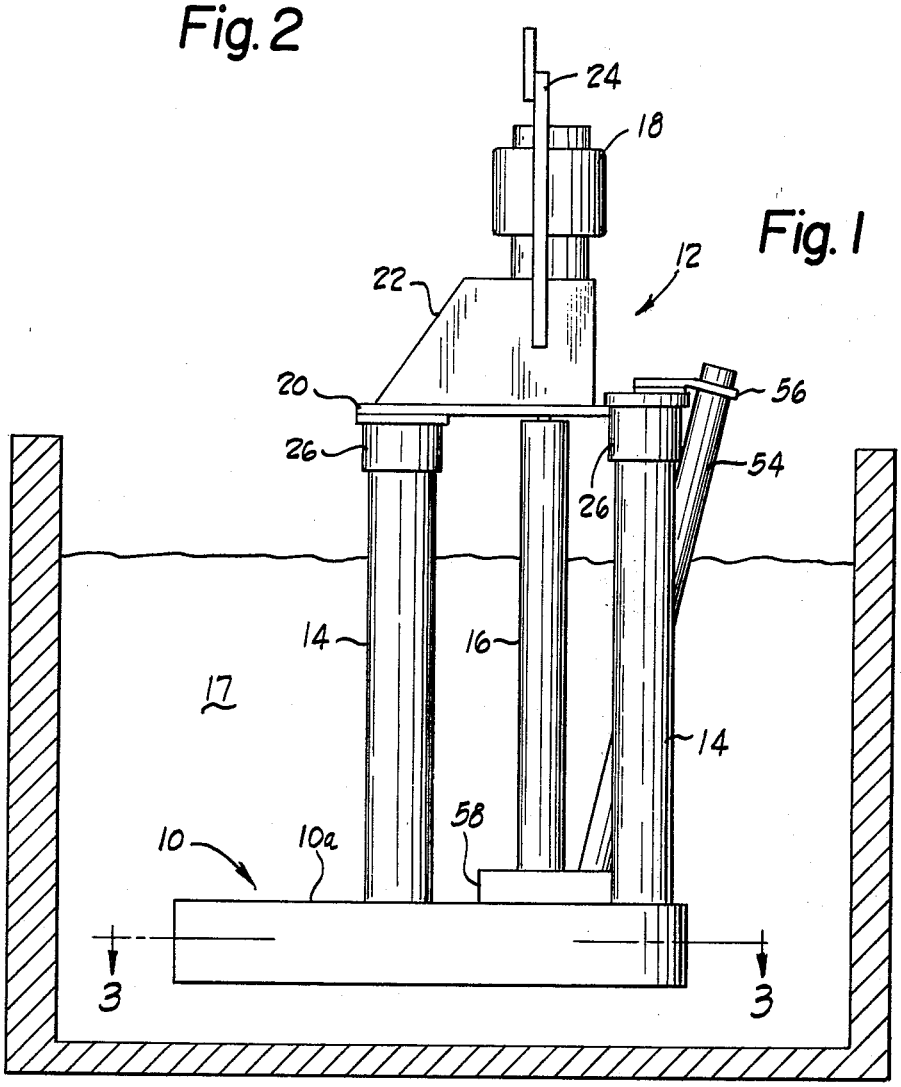
FIG. 1 is a side elevational view of a molten metal pump constructed in accordance with a preferred embodiment of the invention.

FIG. 1 illustrates an overall view of a molten metal pump constructed in accordance with a preferred embodiment of the present invention. The pump comprises a submerged impeller housing 10 and an impeller drive 12 supported above the impeller housing 10 by a plurality of, preferably three, support posts 14. A drive shaft 16 extends from the impeller drive to the impeller housing. The pump shown in FIG. 1 is configured as a submerged discharge-type pump and is used to circulate molten metal in a reservoir 17 to enhance the overall heating process.

Figure 2:
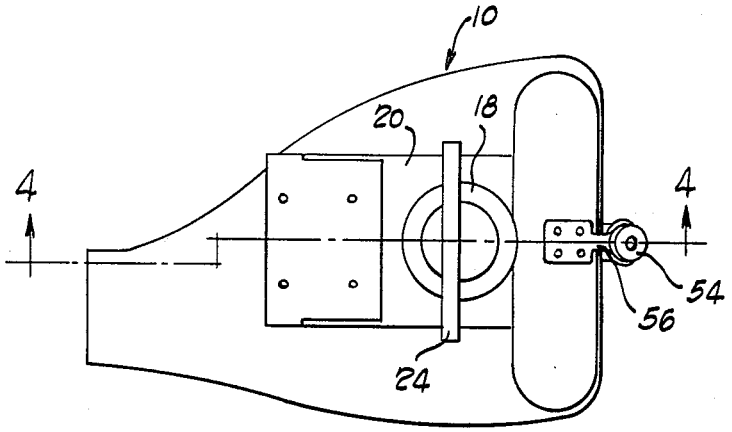
FIG. 2 is a top plan view of the pump shown in FIG. 1.

Referring also to FIG. 2, the impeller drive 12 includes a drive motor 18, preferably air driven, that is attached by a motor mount 22 to a platform 20 that sits atop the support posts 14. A pump hanger 24 extends over the drive motor 18 and includes an aperture (not shown) for engaging a suitable lifting means for lowering and/or suspending the pump in the molten metal bath or reservoir 17. The platform 20 comprises a transverse plate to which are attached depending sockets 26 which receive the top ends of the support posts 14. Suitable fasteners such as set screws (not shown) releasably lock the support posts 14 within the sockets 26.

Referring also to FIGS. 3 and 4, the impeller housing 10 encloses a rotatable impeller 30 that is preferably threadedly attached to the lower end of the drive shaft 16. The impeller 30 is an upturned, cup-shaped element defining a plurality of skewed-radial passages 32 that extend from an outer cylindrical surface 30*a* to an internal bore 34. The bore 34 defines an inlet passage 35 to the pump housing.

The impeller housing 10 includes a machined stepped bore having large and small diameter portions 40*a*, 40*b*, respectively. A volute 42 is mounted in the large diameter portion 40*a* and together with the impeller 30 defines a gradually increasing channel that forms an impeller chamber 38 which merges into an outlet passage 44 defined by the impeller housing 10. The bore 44 joins a diametrically larger outlet bore 45 adapted to receive an outlet conduit if desired (not shown). When the impeller 30 is rotated by the drive shaft 16 molten metal is drawn into the bore 34 and discharged into the impeller chamber 38 through the radial passages 32, by centrifugal force.

An annular cover plate 48 is also cemented into the larger diameter bore portion 40*a* immediately adjacent the volute 42 and includes a replacable impeller bearing ring 50 constructed of a suitable material such as silicone carbide which provides a wear surface for the impeller 30. Preferably the impeller 30 includes a similar replaceable wear ring 52 axially aligned with the ring 50.

The impeller housing 10 also includes a plurality of blind bores 46 that receive the lower ends of the support posts 14 which are preferably cemented to the housing by a suitable high temperature adhesive.

According to the invention, a gas injection conduit 54 extends downwardly from the platform 20 to the pump housing 10, terminating near the inlet 35. A suitable clamp 56 secures the upper end of the conduit 54 to the platform 20.

According to a feature of the invention, a flanged gas inlet collar or ring 58 is coaxially mounted in the smaller diameter bore 40*b* with the flanged portion 58*a* abutting the top surface 10*a* of the impeller housing 10. The inlet ring 58 defines a through passage preferably formed as a venturi throat 60 located coaxial with the drive shaft 16. For purposes of explanation, the venturi throat 60 can be considered as a part or extension of the pump inlet passage 35 and references to the "pump inlet" shall mean the passage formed by the venturi throat 60 and the inlet passage 35 unless otherwise indicated.

The lower end 54*a* of the gas injection conduit 54 is received by and attached to, the inlet ring 58 and communicates with the venturi throat 60 through a passage 62 formed in the inlet ring having radial and a skewed-axial portions.

In operation, as the impeller 30 rotates, fluid is drawn into the inlet, its flow velocity generating an area of low pressure in the venturi throat 60. A purifying reactive gas such as chlorine is injected at the venturi throat by way of the conduit 54 and the passage 62, and is drawn into the impeller housing along with the incoming molten metal. As the molten metal travels through the impeller housing it is mixed with the gas. Any reactive contaminants present in the metal combine with the gas to form substances that are easily removed from the molten reservoir, thereby effecting degassing and/or demagging.

The mounting and location of the gas injection conduit allows for flexibility in mounting locations. Because the end of the injection conduit is a radial distance from the axis of the inlet (as defined by the drive shaft 16) to the pump housing, the conduit can be easily repositioned without requiring structural modification to the pump. The conduit is relocated by rotating the gas inlet ring 58 and refastening the upper end of the gas conduit 54 at a different position on the platform 20. For this reason, clearance difficulties encountered in specific applications can be easily overcome.

Because the gas is injected at the pump inlet and more importantly, in an area of low pressure (produced by the venturi), relatively low gas pressures are needed and the potential for gas escape is reduced. The natural turbulence normally produced in the impeller chamber 36 is used to an advantage for it increases mixing or gas "contact" with the molten metal and thereby enhances the reaction between the contaminants and the gas. It should be understood that the present invention also contemplates an inlet ring 58 formed with a passage having a uniform diameter instead of the venturi throat. In this configuration a slightly higher pressure would be required to inject the gas into the inlet.

Figure 5:
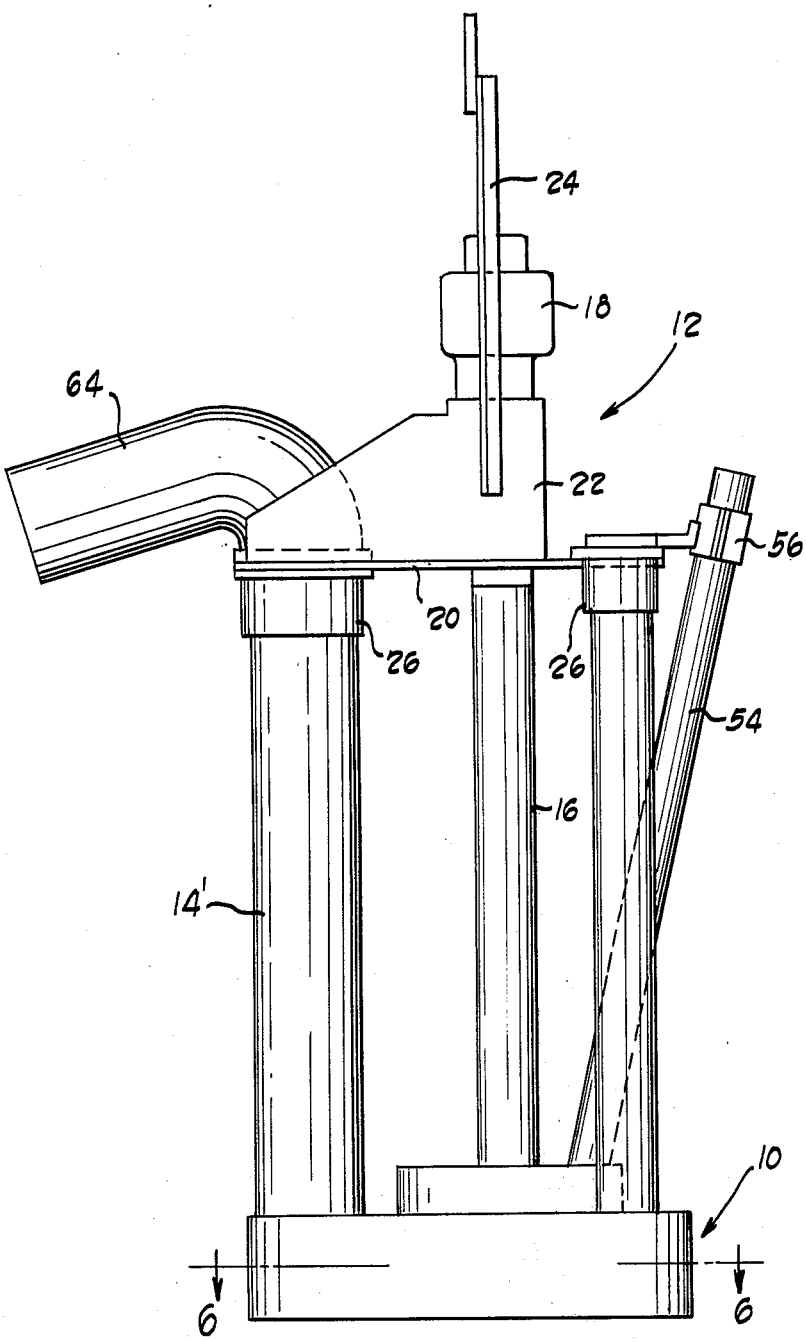
FIG. 5 is a side elevational view of a transfer pump constructed in accordance with the preferred embodiment of the invention.
Figure 6:
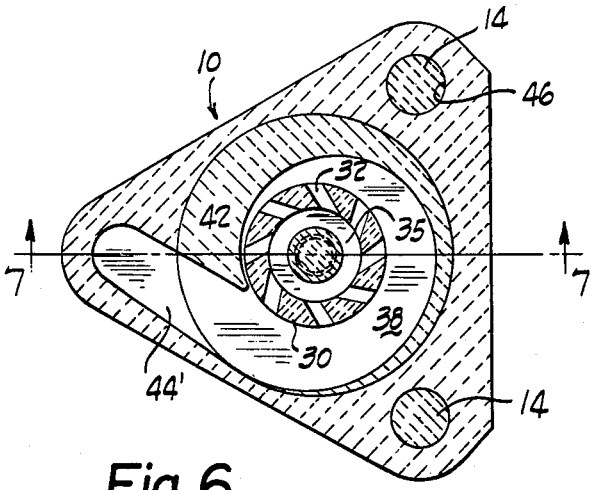
FIG. 6 is a sectional view of the pump shown in FIG. 5 as seen from the plane indicated by the line 6—6 in FIG. 5; and, FIG. 7 is a fragmentary sectional view as seen along the line 7—7 in FIG. 5.
Figure 7:
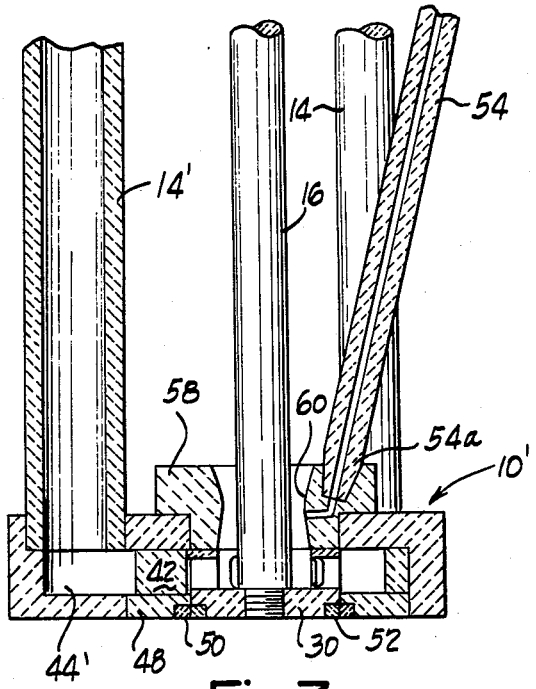

Unlike the prior art, the present invention is easily adapted to either a submerged discharge-type pump disclosed above or a transfer pump having a discharge riser, as shown in FIGS. 5, 6 and 7. Referring to these Figures, the construction of a transfer pump is very similar to that already described in connection with the submerged discharge pump, the difference residing primarily in the construction of the support posts 14. In the transfer-type pump, one of the support posts, indicated by the reference character 14', is diametrically larger than the other posts 14 and is hollow and forms a riser pipe that communicates with the impeller chamber 36 through a relatively short passage 44' formed in a similar impeller housing 10'. As seen in FIGS. 6 and 7, the impeller housing 10' encloses an impeller 30 and mounts a volute 42, a cover plate 48, an inlet ring 58 all of which are substantially identical to those shown in FIG. 4. In operation, molten metal leaving the pump chamber 38 travels upwardly through the riser pipe 14' and then to transfer piping, indicated generally by the reference character 64 which transfers the molten metal from a reservoir to another location or reservoir, etc. (not shown).

The purification efficiency of the pump configuration described should be a marked improvement over the prior art apparatus due to the increased contact time and gas/metal mixing that occurs in the impeller housing 10' and which continues as the molten metal flows through the riser 14' and transfer piping 64.

Although the present invention has been described with a certain degree of particularity, it should be understood that various changes can be made to it by those skilled in the art without departing from the spirit or scope of the invention as described and hereinafter claimed.

I claim:

1. Apparatus for purifying molten metal such as aluminum or the like, comprising:

(a) structure defining a reservoir containing molten metal to be treated;

(b) an impeller housing submerged below the surface of molten metal in said reservoir;

(c) a rotatable pump impeller and a cooperating volute mounted within said housing, together defining an impeller chamber that extends into fluid communication with structure defining an outlet passage for said chamber, said passage disposed below the surface of molten metal;

(d) an impeller drive supported on a platform located above the surface of molten metal and operatively connected to the impeller by a drive shaft, said drive shaft defining an axis of rotation for said impeller;

(e) said impeller housing defining an inlet through which molten metal from said reservoir is drawn upon rotation of said impeller, said inlet located in coaxial alignment with said impeller;

(f) a gas injection conduit in fluid communication with a source of purifying gas, including an output end disposed below the surface of molten metal, in proximity to the inlet; and, (g) a gas injection means located at said inlet including means for receiving the output end of said gas injection conduit and a passage means communicating said output end with said inlet so that gas discharged by said conduit is injected and mixed with molten metal drawn into said inlet during rotation of said impeller, said gas reacting with impurities in said molten metal as said metal travels through said impeller chamber and outlet passage.

2. The purifying apparatus of claim 1 wherein said impeller chamber outlet passage opens into said reservoir so that molten metal is discharged by said outlet passage, below the surface of the reservoir.

3. The apparatus of claim 1, wherein said gas injection means defines a venturi coaxial with said inlet and said passage means communicates the output end of said conduit with the throat of said venturi.

4. The apparatus of claim 1, wherein an upper end of said conduit is releasably fastened to said drive platform and said gas injection member is rotatable thereby allowing said conduit to be alternately positioned along the perimeter of the purifying apparatus.

5. The apparatus of claim 1, wherein said outlet passage is connected to a discharge riser pipe that extends above the surface of the molten metal.

* * * * *